US009347170B2

(12) United States Patent
Moore

(10) Patent No.: US 9,347,170 B2
(45) Date of Patent: May 24, 2016

(54) COLLAPSIBLE CLOTHES HANGING AND DRYING APPARATUS

(71) Applicant: Lynnette Van Orden Moore, Woodland Hills, CA (US)

(72) Inventor: Lynnette Van Orden Moore, Woodland Hills, CA (US)

( * ) Notice: Subject to any disclaimer, the term of this patent is extended or adjusted under 35 U.S.C. 154(b) by 342 days.

(21) Appl. No.: 14/060,188

(22) Filed: Oct. 22, 2013

(65) Prior Publication Data

US 2014/0109433 A1 Apr. 24, 2014

Related U.S. Application Data

(60) Provisional application No. 61/795,660, filed on Oct. 22, 2012.

(51) Int. Cl.

| | |
|---|---|
| ***F26B 5/06*** | (2006.01) |
| ***D06F 57/08*** | (2006.01) |
| *D06F 57/12* | (2006.01) |

(52) U.S. Cl.

CPC ..... *D06F 57/08* (2013.01); *D06F 57/12* (2013.01)

(58) Field of Classification Search

CPC ..... D06F 57/08; D06F 57/12; D06F 58/14; D06F 58/10; D06F 57/04; D06F 57/122; D06F 53/00; F26B 9/00; F26B 9/003; F26B 25/18; A47L 19/04; A47G 25/0664; A47G 5/00

USPC ..... 34/282

See application file for complete search history.

(56) References Cited

U.S. PATENT DOCUMENTS

| | | | | | |
|---|---|---|---|---|---|
| 838,382 | A * | 12/1906 | Caswell | A47G 5/00 | 160/352 |
| 1,962,205 | A * | 6/1934 | Murray | D06F 57/12 | 211/104 |
| 2,956,689 | A * | 10/1960 | Van Der Togt | B29C 63/18 | 211/104 |
| 3,437,213 | A * | 4/1969 | Ruina | A47K 10/06 | 211/1.3 |
| 3,651,851 | A * | 3/1972 | Curtis | E04H 17/161 | 119/514 |
| 4,162,730 | A * | 7/1979 | Steere, Jr. | D06F 57/12 | 211/118 |
| 8,225,525 | B1 * | 7/2012 | Gallagher | A45C 9/00 | 206/288 |
| 2005/0145583 | A1 * | 7/2005 | Martorella | A47L 19/04 | 211/41.6 |
| 2006/0288917 | A1 * | 12/2006 | Wood | A47B 3/06 | 108/115 |

* cited by examiner

*Primary Examiner* — Kenneth Rinehart
*Assistant Examiner* — Bao D Nguyen
(74) *Attorney, Agent, or Firm* — Edwin Tarver

(57) ABSTRACT

An expandable and customizable cabinet apparatus for supporting clothes when hanging them to dry includes a housing that forms an enclosure with an opening on one side. A door connected to the housing is able to open to substantially 180 degrees. A frame is connected in a hinging arrangement to the housing allowing it to swing relative to the housing between the housing and the door. The frame includes an anchoring grid. A series of articulating hanging racks are affixed to the anchoring grid and held in a horizontal position with support members. The hanging racks may be articulated downward to a position flush with the anchoring grid, and the enclosed with the frame inside the housing and door when closed.

11 Claims, 10 Drawing Sheets

COLLAPSIBLE CLOTHES HANGING AND DRYING APPARATUS

This application claims the benefit of the filing date of provisional application No. 61/795,660, filed on Oct. 22, 2012.

BACKGROUND

Clothes drying mechanisms are known in the art and typically comprise machines for agitating wet apparel along with the application of heated air. Although these types of apparatus are useful for drying clothes in bulk, they may not be useful for drying small amounts of clothing, drying clothing that cannot tolerate high temperatures, and fabrics prone to shrinkage. Electrical clothes dryers also consume power and are subject to power loss conditions.

Hanging after washing has been the universal method for drying clothes, both before the advent of electrical clothes drying apparatus and remains a popular means of drying apparel. Typical methods for hang-drying clothes involve draping items of apparel over a taught line or cable. Although typical clothes lines comprise long single or parallel lines, apparatus known in the art include matrices of lines strung around a frame, etc. These clothes drying apparatus, while avoiding the drawbacks of electrical clothes dryers, present other problems due to the large areas they encompass. Even apparatus comprising lines strung on a frame are frequently too large to fit indoors and consequently may not be used during inclement weather.

Apparatus for hang-drying clothes indoors are also known in the art. These apparatus typically present a dowel or multiple dowels installed between articulating sides that scissor open and closed. In this manner, such an apparatus may be "opened" to space apart the dowels, allowing a user to hang apparel thereon. These apparatus suffer from the drawback that they lack sufficient space for hanging multiple items of clothing, and are typically flimsy and prone to breakage and collapse.

There is therefore a need for a laundry hanging apparatus that uses no electricity, that provides ample space for hanging items of clothing, and which is strong and sturdy enough to hold heavy, wet items. There is also a need for a laundry apparatus that is customizable according to the number of clothes needing to be dried, which presents both means for hanging clothes on hangers and for placing clothes on shelves for items of apparel which may not be dried in a hanging configuration, also, an apparatus that may be employed indoors, and which may be easily unfolded and refolded for convenient storage.

SUMMARY

An expandable and customizable cabinet apparatus is adapted for supporting a variety of clothes when hanging them to dry. The cabinet includes a housing that forms an enclosure. The enclosure may be approximately 3.5 inches in depth, and preferably includes a divider that forms a storage pocket inside the enclosure. The enclosure is open on at least one side. A door is connected to the housing by a hinge so that the door covers the opening when closed. In order to cause the door to cover the face of the opening, one or more hinges may connect the door and the housing on an outside portion of the housing.

A first frame is connected to the housing in a hinged manner that allows the frame to move into and out of the housing. By hinging the frame inside the housing, the frame can travel entirely out of, or into the housing, which allows the door to completely obscure the opening, thereby sealing the cabinet and first frame therein. An anchoring member is disposed in the frame. Preferably, the anchoring member is a planar grid of metal wire, or a material having similar characteristics. In one embodiment, the anchoring member is affixed to the frame using connectors.

A rack member is attached to the anchoring member in a manner allowing it to articulate relative to the anchoring member. In various embodiments, multiple rack members may be affixed to the anchoring member in a variety of places. Preferably each rack member includes horizontal rungs connected to two side members. Each side member terminates on a common end in a hook for engaging the anchoring member. In order to preserve a rack member in a horizontal position, support members also connect the rack members to the anchoring member.

In order to connect a support member to a rack member, the ends of each support member include a double curve. A linear segment between the double curves defines the length of each support member. The double curves serve to allow a support member to pull a rack member relative to the anchoring member or to push a rack member relative to the anchoring member. In this manner, support members may hold a rack member horizontally at the top of the anchoring member by pushing up on it, while others hold a rack member horizontally at the bottom of the anchoring member by pulling up on it.

The cabinet is modular, allowing a several rack members to be affixed to the anchoring member according to user preference. Furthermore, since the anchoring member articulates relative to the housing. The anchoring member may be swung out to be perpendicular to the housing, and rack members hung from both sides of the anchoring member. Since this fully extended configuration may not always be necessary depending on the amount of laundry to be dried, a releasable lock holds the first frame in position relative to the housing, allowing rack members to swing outward from the cabinet in a smaller configuration. Releasing the lock allows the first frame and anchoring member to swing freely.

In one preferred embodiment, a second frame is affixed to the inside of the door, the second frame also including an anchoring member. In this manner, rack members may be affixed to the anchoring member in the second frame as well, thereby increasing the amount of laundry that may be hung from the cabinet.

In addition to the rack members, a mesh rack is preferably included with the cabinet. The mesh rack includes a mesh of wire or cloth mesh strung on a frame preferably substantially the same size as the rack member. Feet on the mesh rack are concave to help align the mesh rack with the rack member. Preferably, the mesh includes a hook and latch or similar anchoring material to affix it to the rack member, thereby holding the mesh rack in place on the rack member as the rack member is articulated down from a horizontal position. This also allows the mesh rack to remain affixed to a rack member as it and the anchoring member are swung into the housing and the cabinet closed after use.

To form a sturdy and resilient cabinet, the housing may be made of ⅛ inch steel plate, and the frame may be constructed from ¾ inch steel tubing. The anchoring member may comprise a metal grid of ¼ inch steel wire, while the rack members are also constructed of a similar gauge steel wire.

To use the cabinet, a user first opens the cabinet door. If only a small number of clothes need to be dried, the user may leave the first frame in a locked position and place a rack member on the anchoring member by affixing the hooks in the rack member to a portion of the grid of the anchoring member. One contemplated configuration is a rack member disposed at the top of the anchoring member and a rack member disposed at the bottom of the anchoring member. The rack members are held in a horizontal position relative to the anchoring member using support members.

If drying a greater quantity of laundry is needed, a user may engage the spring-loaded pin on the exterior of the housing which allows the first frame to articulate out away from the housing along a vertical axis. Once the first frame is substantially ninety degrees away from the housing, and the door substantially 180 degrees open, hanging racks may be affixed to both sides of the anchoring member, and, optionally, may be affixed to a second anchoring member housed in the second frame on the inside of the door.

For drying specialty items, such as items that crease if hung from a hanger or hanging rack, or are too small to hang, a mesh rack may be affixed to one of the hanging racks. A user aligns the feet of the mesh rack to engage a hanging rack, and optionally connects the mesh rack to the hanging rack using a hook and latch or similar fastener. Clothes and clothes hangers may then be suspended from the hanging racks, with smaller items stowed on the mesh rack, and all laundry allowed to air dry.

Once clothing is dry and removed from the hanging racks and mesh rack, the supporting members may be disengaged and stored in the housing pocket. Then the hanging racks may be articulated or folded against the anchoring member in the first rack, and the first rack folded into the housing. The door may then be closed until the cabinet is needed for further use.

REFERENCE NUMBERS

10. Cabinet
12. Housing
14. Door
16. Divider
18. Pocket
20. Locking Pin
22. First Frame
24. First Grid
26. Support Member
28. Hanging Rack
30. Mesh Rack
32. Second Grid
34. Second Frame
36. Connector
38. Inner Hinge
40. Outer Hinge
42. Mounting Screw
44. Anchoring Screw
46. Retaining Loop
48. First Turn
50. Second Turn
52. Blunt Ends
54. Hook
56. Feet
58. Hook and Latch Material
59. Mesh
60. Handle

DESCRIPTION

Figure 1:
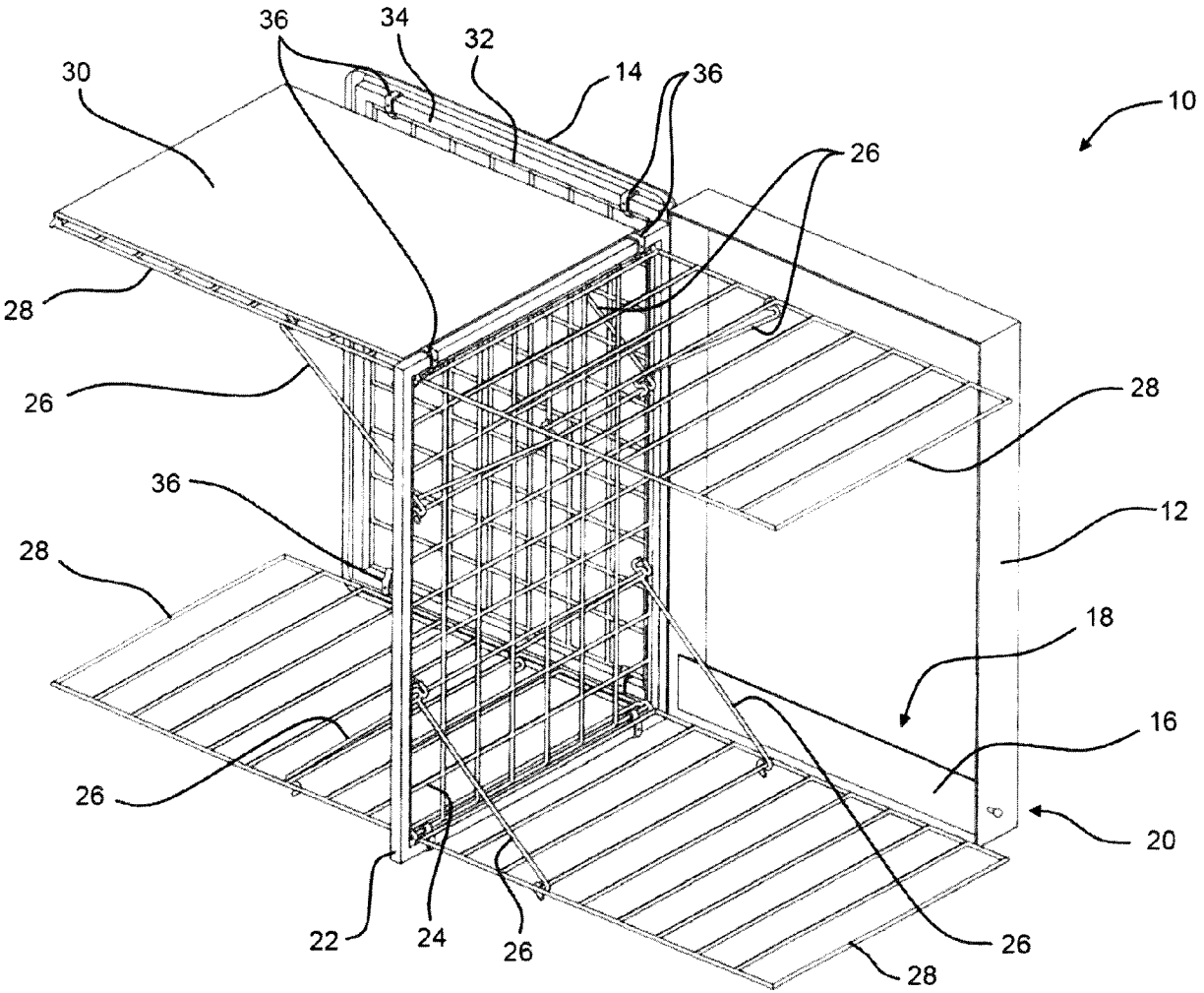
FIG. 1 is a perspective view of a collapsible clothes hanging and drying cabinet in an open configuration.

Referring to FIG. 1, the collapsible clothes hanging and drying cabinet ("cabinet") 10 is shown in a fully opened configuration. The cabinet includes a housing 12 and a door 14 connected to the housing 12 using a first hinge (not shown, see FIG. 2). The housing also includes a divider 16 which forms a pocket 18 in the housing 12, and preferably includes a locking pin 20, which may be a spring loaded locking pin 20. Operation of the locking pin 20 will be discussed in reference to FIG. 4 below.

Figure 2:
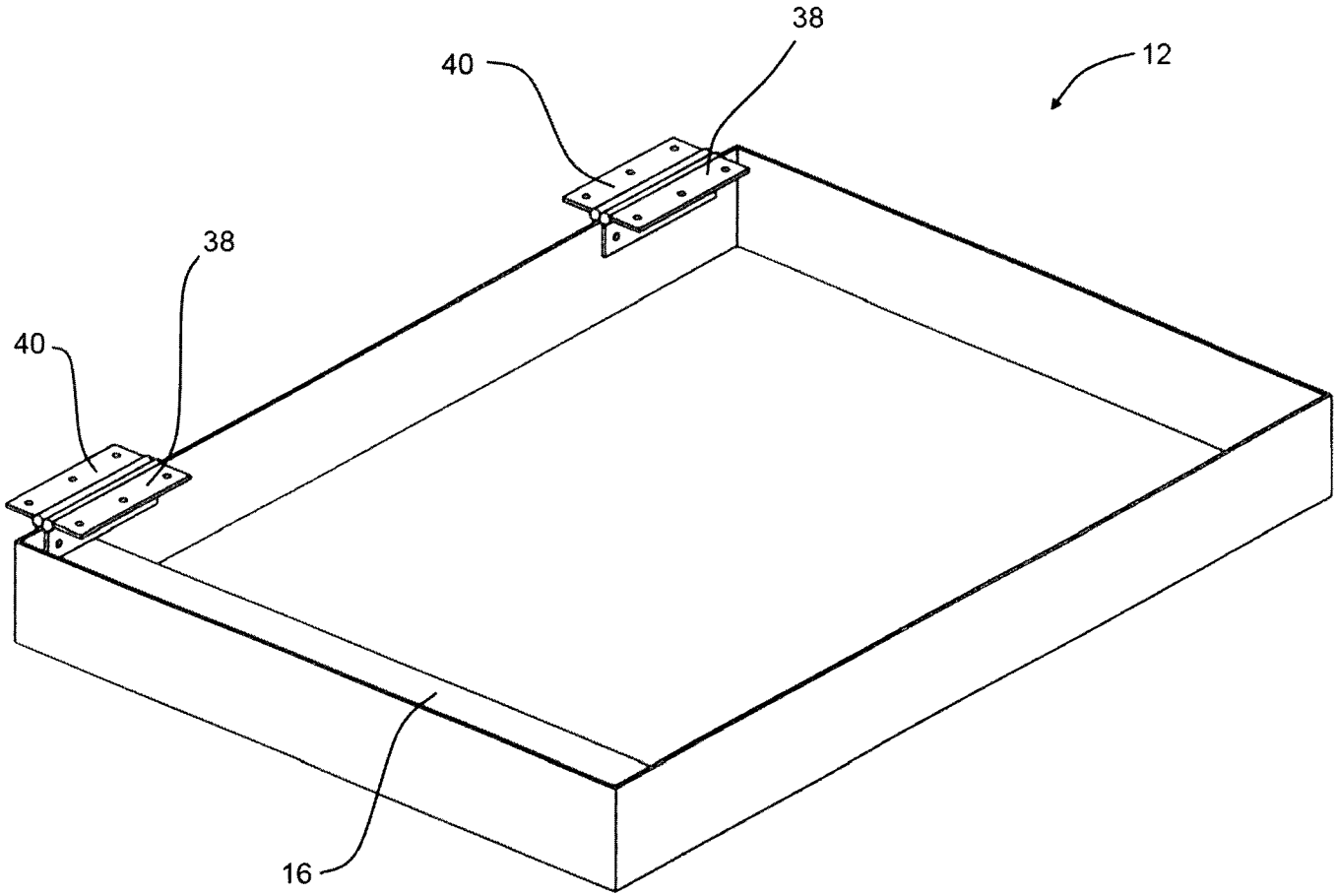
FIG. 2 is a perspective view of the housing thereof.

Still referring to FIG. 1, a first frame 22 is disposed between the housing 12 and the door 14 in an articulating manner using a second hinge (not shown, see FIG. 2). The first frame 22 may be constructed so that it rotates into the housing 12 when the door 14 closes in order to completely seal the cabinet 10. In a preferred embodiment, the first frame holds a first grid 24, which may be a wire grid 24. The grid allows the attachment of support members 26, which hold a series of hanging racks 28 hingedly attached to the first frame 22. In this manner, the hanging racks 28 may be articulated to fold against the grid 24, and allow the first frame 22 and hanging racks 28 to fit inside the housing 12.

To add additional functionality, a mesh rack 30 may be included, anchored to the first frame 22, and may articulate relative to the first frame 22 similar to the hanging racks 28. The mesh rack 30 may be included for holding a variety of items, including clothes made of impressionable material that may undesirably retain the wire pattern of the hanging racks 28. The mesh rack 30 is also useful for holding bottles and product containers that would fall through the hanging racks 28.

To maximize the hanging functionality of the cabinet 10, the mesh rack 30 preferably sits atop a hanging rack 28, such that clothes may be suspended from the hanging rack 28 underside of the mesh rack 30 when the cabinet 10 is open. The door 14 preferably also includes a second grid 32, similar to the first grid 24, to provide additional space for hanging items such as small articles of clothing, etc. For stability, the second grid 32 is held within a second frame 34. The first grid 24 and second grid 32 are held to the first frame 22 and second frame 34, respectively using connectors 36.

Referring to FIG. 2, the housing 12 is shown separate from the cabinet 10 (not shown). The housing may be constructed of ⅛" steel plate for stability and is preferably approximately 3.5 inches deep. The divider at the bottom of the housing 12 is also preferably ⅗ inches wide, and recessed into the housing 12 sufficiently to allow the first frame 22 (not shown) and related hardware to rest in the housing 12 when the cabinet 10 is closed.

In order to facilitate closure of the cabinet 10 and storage of the first frame 22, two sets of hinges are used. A pair of inner hinges 38 is disposed on the interior of the housing 12 to bring the first frame 22 into the housing when closed. A complimentary pair of outer hinges 40 is disposed on the exterior of the housing to bring the door 14 (not shown) against the housing 12 when closed. In various embodiments, the inner hinges 38 may be placed opposite the outer hinges 40 as shown, or they may be staggered. Additionally, one or more hinges may be employed according to preference.

Figure 3:
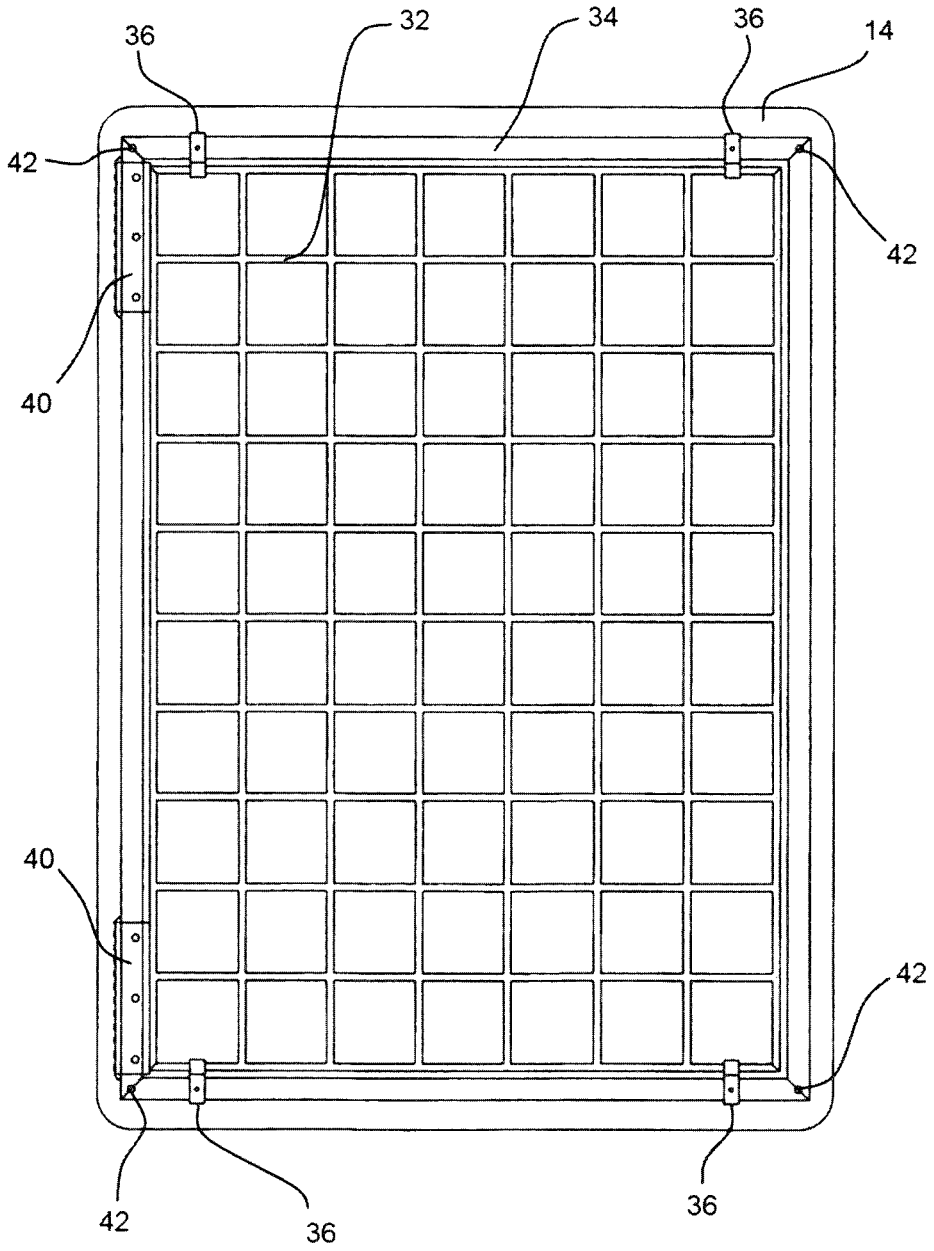
FIG. 3 is a side view of a grid and frame thereof.

Referring to FIG. 3, the interior of the door 14 is shown with the second grid 32 and second frame 34 attached. The second grid 32 is attached to the second frame 34 using connectors 36, and the second frame 34 is attached to the door 14 using mounting screws 42 or a similar attachment mechanism. The outer hinges 40 are shown, which connect the door 14 and related assembly to the housing 12 (not shown). In one embodiment, the second frame may be approximately 32.25 inches in height, and 23.25 inches in width, to fit just within the inside dimensions of the housing 12 when the door 14 is closed. Also, due to the thickness of the second frame 34, room is provided for inserting clothing (not shown) or support members 26 (not shown) into the second grid 32.

Figure 4:
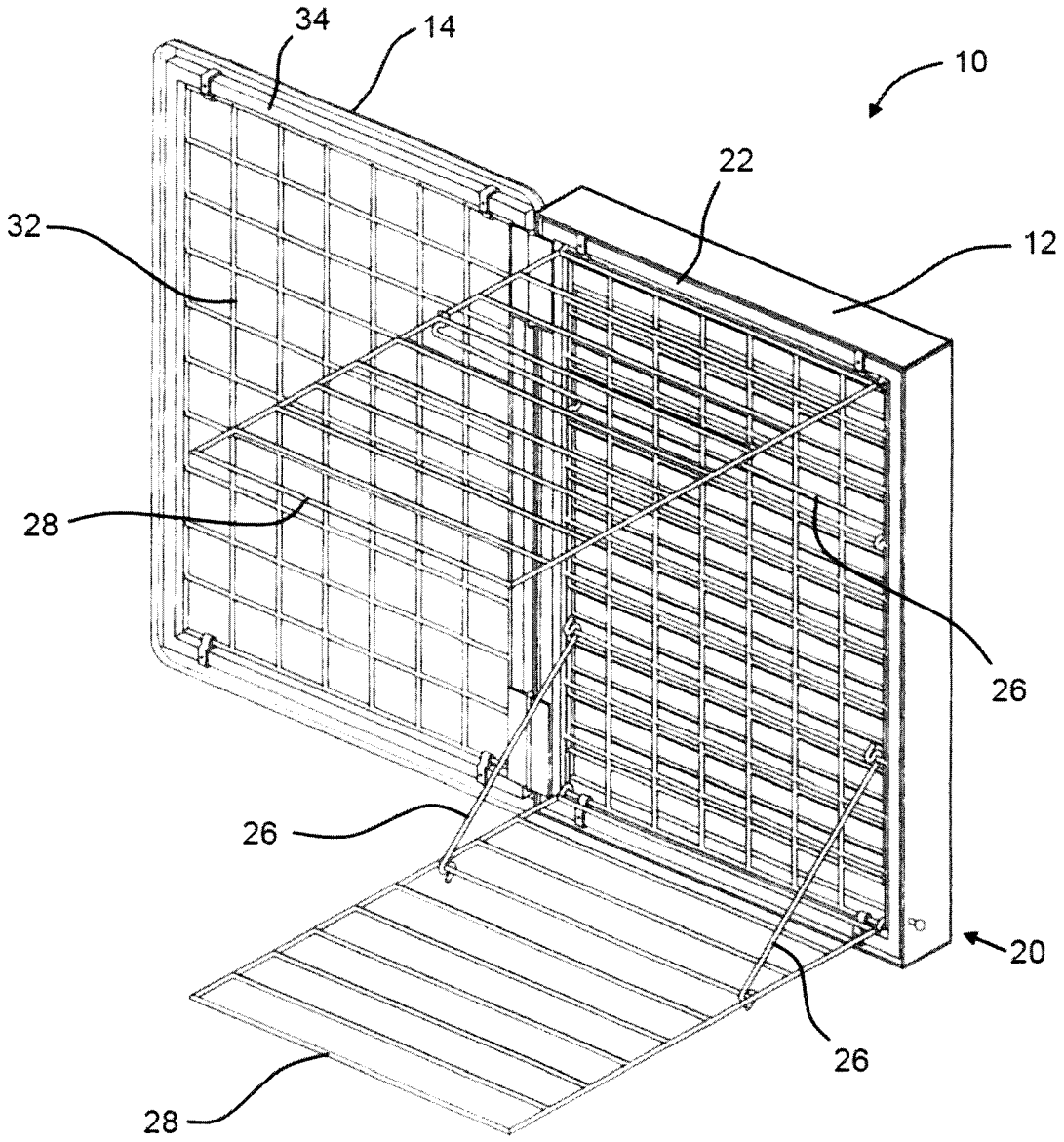
FIG. 4 is a perspective view of a collapsible clothes hanging and drying cabinet in a partially open configuration.

Referring to FIG. 4, the cabinet 10 is shown in a partially open view. When less capacity is needed, the door 14 of the cabinet 10 may be opened, but the first frame 22 may be left in position inside the cabinet 10. The locking pin 20 is preferably a spring loaded locking pin 20, which engages the first frame 22 when it is in a closed position in the housing 12. In this manner, the first frame 22 is held in position unless released by the locking pin 20. Hanging racks 28 may be articulated to fold out from the housing 12 suspended on support members, which hold the hanging racks 28 in position. With the door 14 open, the second grid 32 may be used to hang clothes or other items as well.

Figure 5:
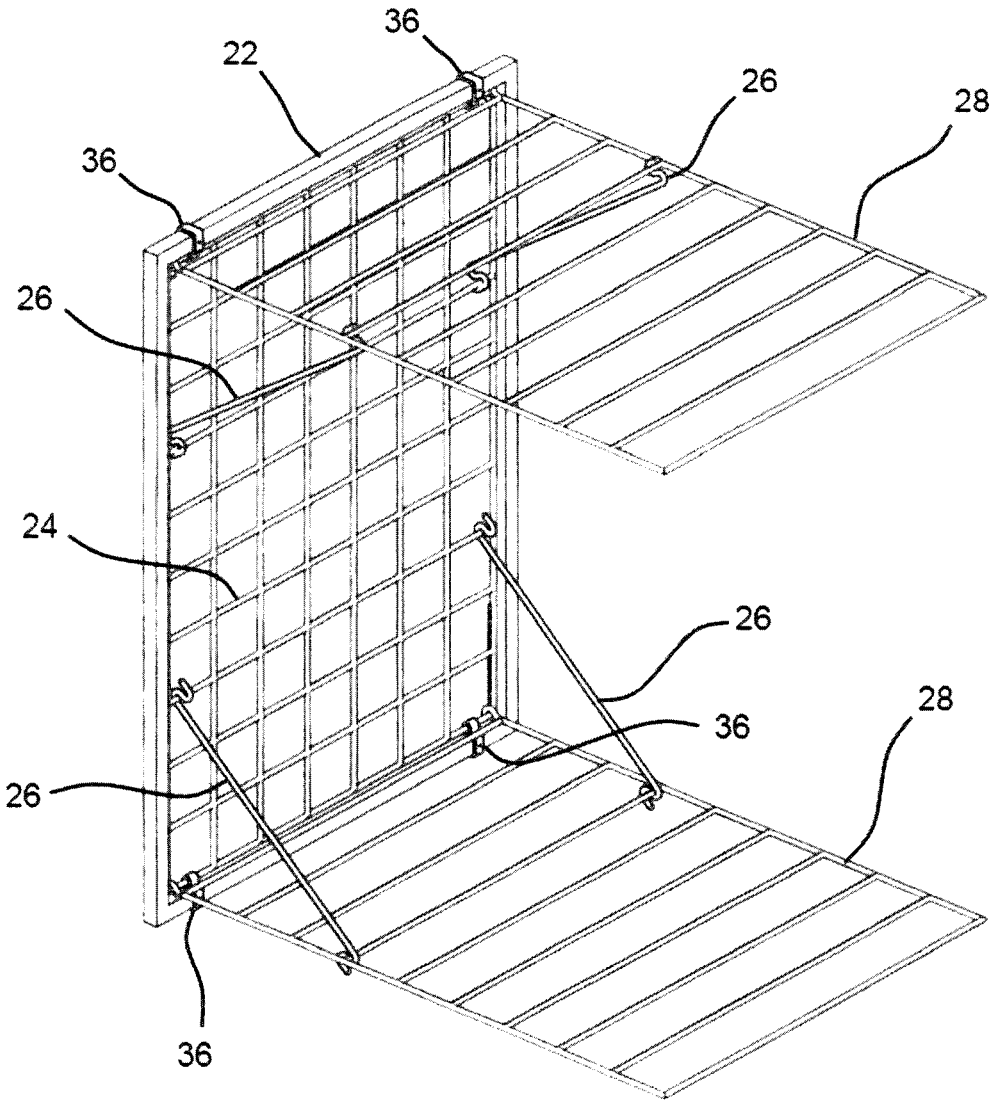
FIG. 5 is a perspective view of grid and frame with hanging racks disposed thereon.
Figure 6:
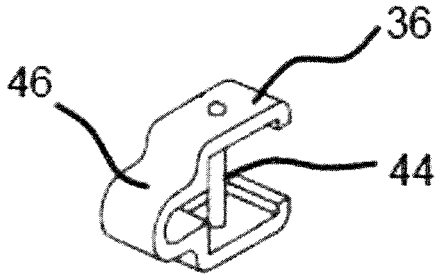
FIG. 6 is a perspective view of a connector.
Figure 7:
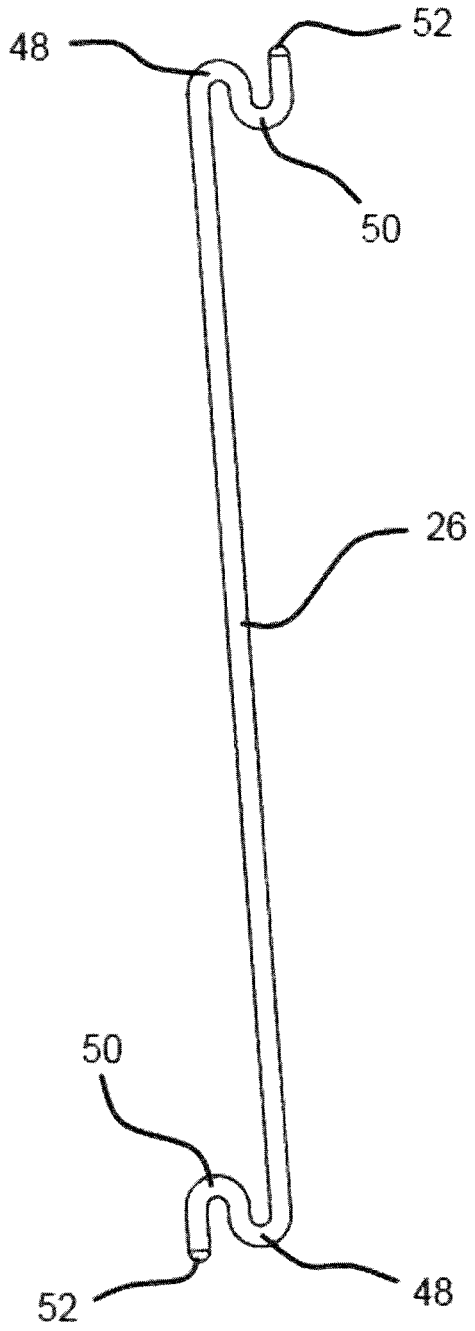
FIG. 7 is a side view of a support member.

Referring to FIGS. 5, 6 and 7, the connections between the first frame 22, first grid 24 and hanging racks 28 are shown. Referring to FIG. 5, the first grid 24 is anchored into the first frame 22 using connectors 36. With the first grid 24 held in place, the hanging racks 28 may be attached to the first grid 24 and supported in a horizontal orientation by the support members 26.

Referring to FIG. 6, each connector 36 includes an anchoring screw 44 adapted to extend through the first frame 22 (not shown) or second frame 34 (not shown). The connectors 36 also include a retaining loop 46 for looping around the outer edge of either the first grid 24 (not shown) or second grid 32 (not shown).

Referring to FIG. 7, each support member 26 includes two ends 52 having a first turn 48 and a second turn 50 in an opposite direction. In this manner, each end 52 of each support member 26 may be used to retain a hanging rack 28 (not shown) in a pulling or pushing orientation. For example, a support member under gravitational pull away from a grid would need support from the first turn 48, while a support member under gravitational pull toward a grid would need support from the second turn 50. Preferably the ends 52 of each support member 26 are blunted to avoid scratching and facilitate ease of installation.

Figure 8:
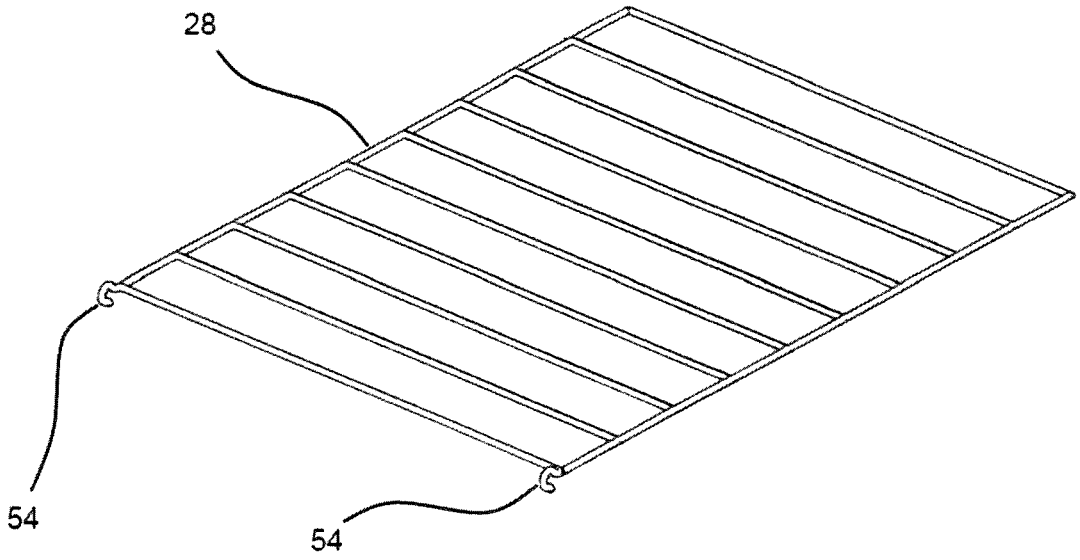
FIG. 8 is a perspective view of a hanging rack.

Referring to FIG. 8, a hanging rack 28 is shown in perspective view. An important component of the hanging rack 28, which allows it to be anchored to either the first grid 24 (not shown) or second grid 32 (not shown), are hooks 54, which are partially open, allowing the hanging rack 28 to be inserted on, articulated relative to, and removed from one of the grids.

Figure 9B:
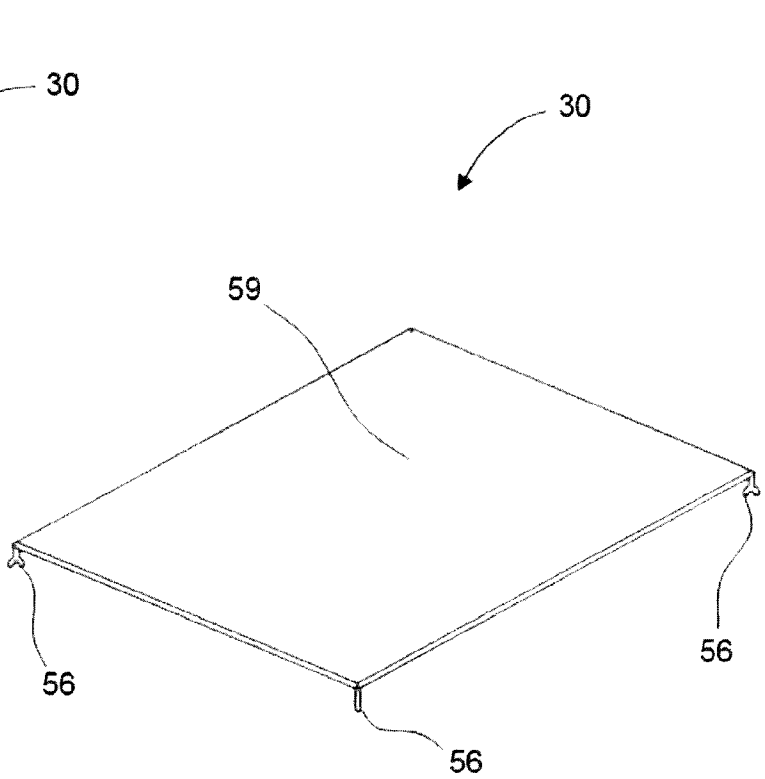
FIGS. 9A and 9B are a top view and a perspective view, respectively, of a mesh rack.
Figure 9A:
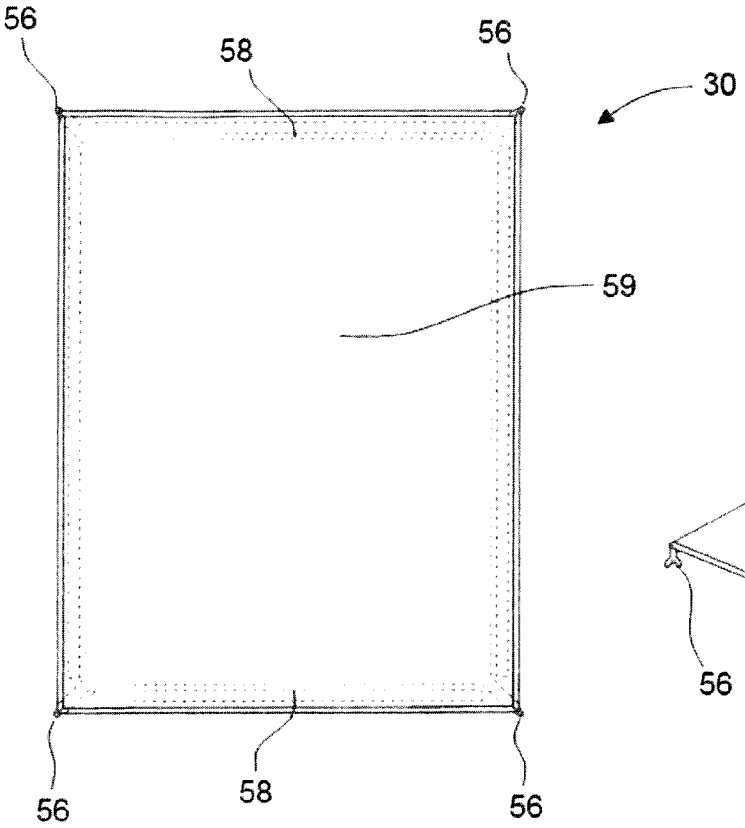

Referring to FIGS. 9A and 9B, the mesh rack 30 is shown in top and perspective view. The mesh rack provides a mesh 59 surface, which may be a wire mesh or a cloth mesh according to preference. The mesh rack is sized to rest on a hanging rack 28 (not shown) using feet 56. Ideally the feet 56 have concave surfaces for engaging the ¼ inch steel wire used to create a hanging rack 28. In addition to the feet 56, which anchor on a hanging rack, preferably, the mesh rack 30 includes hook and latch material 58 (e.g., VELCRO®) which can be wrapped around a hanging rack 28 for added stability. With the hook and latch material 58 installed on a hanging rack 28, the mesh rack 30 may be articulated into a vertical position for storage without falling off the hanging rack 28.

Figure 10:
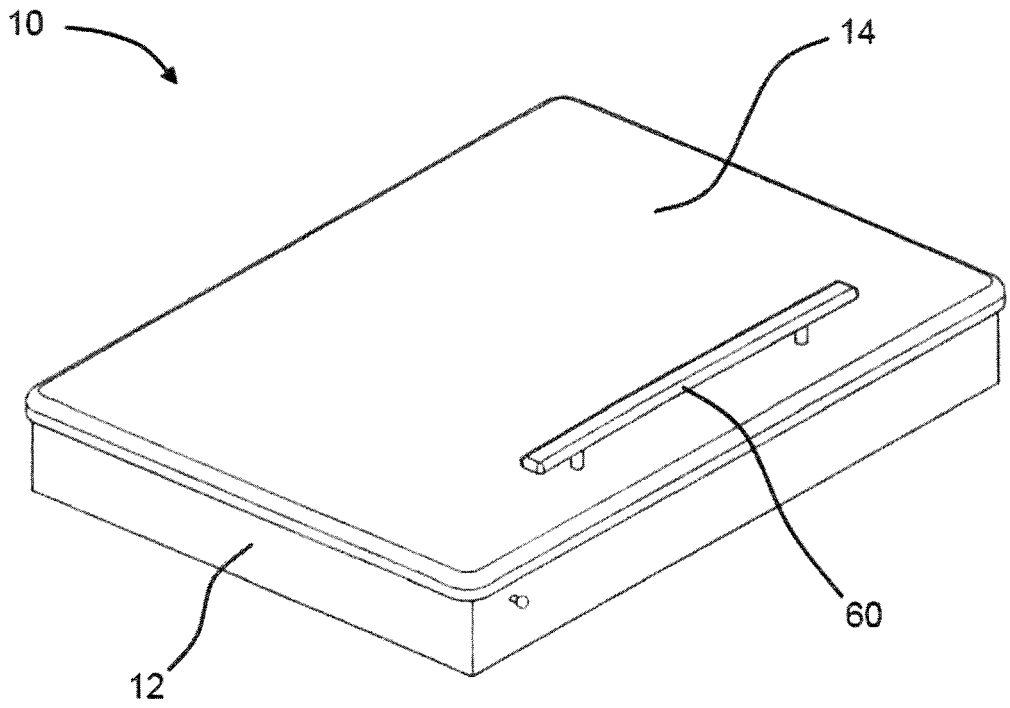
FIG. 10 is a perspective view of the collapsible clothes hanging and drying cabinet in a closed configuration.

Referring to FIG. 10, the cabinet 10 is shown in a closed configuration. In this configuration, all hanging hardware is stored in the housing 12, and the door 14 is closed flush with the housing 12. Preferably the door includes a handle 60, and may also comprise means for preserving the door 14 in a closed configuration, such as a magnetic or other type of latch (not shown). As shown the door 14 may be slightly larger than the housing 12 to present an attractive appearance to the cabinet 10. The cabinet 10 is preferably mounted in a location convenient to a laundry, such as above a washer or dryer or on a wall adjacent the same.

The foregoing description is sufficient in detail to enable one skilled in the art to make and use the invention. It is understood, however, that the detail of the preferred embodiments presented is not intended to limit the scope of the invention, inasmuch as equivalents thereof and other modification which come within the scope of the invention as defined by the claims will become apparent to those skilled in the art upon reading this specification.

What is claimed is:

1. An expandable and customizable cabinet apparatus for supporting clothes when hung to dry, comprising:

a housing forming an enclosure having an opening;

a door hingedly connected to the housing so that the door covers the opening when closed;

a first frame hingedly connected to the housing in as manner allowing the frame to move into the enclosure, thereby allowing the door to cover the opening;

an anchoring member disposed in the frame; and a rack member attached to the anchoring member in a manner allowing it to articulate relative to the anchoring member, wherein the rack member comprises horizontal rungs between two side members.

2. The apparatus of claim 1 further comprising a releasable lock that holds the first frame in position relative to the housing.

3. The apparatus of claim 1 wherein the housing includes as storage pocket.

4. The apparatus of claim 1 wherein the anchoring member is as planar grid.

5. The apparatus of claim 1 wherein each side member terminates in a hook for engaging the anchoring member.

6. The apparatus of claim 1 further comprising a removable support member for holding the rack member in a horizontal position.

7. The apparatus of claim 6 wherein the removable support member comprises a linear segment bound by opposite ends, each end having a double curve.

8. The apparatus of claim 1 further comprising a second frame affixed to the door.

9. The apparatus of claim 1 further comprising a mesh rack affixed to a rack member.

10. The apparatus of claim 1 wherein the anchoring member comprises steel wire.

11. The apparatus of claim 1 wherein the rack member comprises steel wire.

* * * * *